US006277033B1

(12) United States Patent
Krumme et al.

(10) Patent No.: US 6,277,033 B1
(45) **Date of Patent: *Aug. 21, 2001**

(54) GOLF CLUB HEAD OR FACE

(75) Inventors: John F. Krumme, Tahoe City; Frank C. Dickinson, Redwood City, both of CA (US)

(73) Assignee: Pixl Golf Technologies, Inc., Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/137,310

(22) Filed: Aug. 21, 1998

Related U.S. Application Data

(63) Continuation of application No. 08/760,251, filed on Dec. 5, 1996, now Pat. No. 5,807,190.

(51) Int. Cl.[7] ..... A63B 53/04
(52) U.S. Cl. ..... 473/342; 473/329
(58) Field of Search ..... 473/340, 329, 473/330, 331, 325, 342

(56) References Cited

U.S. PATENT DOCUMENTS

| | | |
|---|---|---|
| D. 57,980 | 5/1921 | Kraeuter . |
| D. 63,284 | 11/1923 | Challis . |
| D. 79,684 | 10/1929 | Munro-Spencer . |
| D. 138,380 | 7/1944 | Myers et al. . |
| D. 340,492 | 10/1993 | Flood . |
| D. 368,126 | 3/1996 | Magerman et al. . |
| D. 411,275 | 6/1999 | Bottema et al. . |
| D. 415,809 | 10/1999 | Bottema et al. . |
| 732,136 | 6/1903 | Taylor . |
| 1,094,599 | 4/1914 | Samson . |
| 1,289,553 | 12/1918 | Sanders . |
| 1,337,958 | 4/1920 | Reach . |
| 1,494,494 | 5/1924 | Lippincott . |
| 1,524,731 | 2/1925 | Davis . |
| 1,526,951 | 2/1925 | Beaumont . |
| 1,532,545 | 4/1925 | Pedersen . |
| 1,535,670 | 4/1925 | Kidd . |
| 1,595,589 | 8/1926 | Tyler . |

(List continued on next page.)

FOREIGN PATENT DOCUMENTS

| | | |
|---|---|---|
| 0 710 493 | 5/1996 | (EP) . |
| 2185891 A | 8/1987 | (GB) . |
| 55-34835 | 3/1980 | (JP) . |
| 60-47564 | 3/1985 | (JP) . |
| 3-23877 | 1/1991 | (JP) . |
| 4-47468 | 2/1992 | (JP) . |

*Primary Examiner*—William M. Pierce
(74) *Attorney, Agent, or Firm*—Burns, Doane, Swecker & Mathis, L.L.P.

(57) ABSTRACT

A striking face for golf clubs, such as a driver, iron or putter, includes zones of the same or different material arranged to create a desired "feel" to the golfer and/or produce a desired effect on the golf ball. For instance, the zones can be arranged to create a variation in mechanical properties across the striking face. The zones can be created by using "pixels" such as round or hexagonal rods arranged with their central axes perpendicular to the striking face. Pixels of a first material such as a shape memory alloy such as superelastic NiTi can be arranged in one or more concentric patterns and the remainder of the striking face can be made up of pixels of a second material such as beta-titanium, martensitic NiTi or stainless steel. The superelastic NiTi pixels can thus create a sweet spot on the striking face of the club.

12 Claims, 5 Drawing Sheets

U.S. PATENT DOCUMENTS

| | | | |
|---|---|---|---|
| 1,646,461 | | 10/1927 | So Relle . |
| 1,654,257 | | 12/1927 | Hillerich . |
| 1,659,272 | * | 2/1928 | Link . |
| 1,968,626 | | 7/1934 | Young . |
| 2,429,351 | | 10/1947 | Fetterolf . |
| 3,211,455 | | 10/1965 | Hyden . |
| 3,869,126 | | 3/1975 | Thompson . |
| 4,027,885 | | 6/1977 | Rogers . |
| 4,156,526 | | 5/1979 | Huggins et al. . |
| 4,413,825 | | 11/1983 | Sasse . |
| 4,422,638 | | 12/1983 | Tucker . |
| 4,508,349 | | 4/1985 | Gebauer et al. . |
| 4,529,203 | | 7/1985 | Ribaudo . |
| 4,679,792 | | 7/1987 | Straza et al. . |
| 4,681,322 | | 7/1987 | Straza et al. . |
| 4,740,345 | | 4/1988 | Nagasaki et al. . |
| 4,768,787 | | 9/1988 | Shira . |
| 4,884,808 | | 12/1989 | Retzer . |
| 4,964,641 | | 10/1990 | Miesch et al. . |
| 4,999,000 | | 3/1991 | Finney . |
| 5,083,778 | | 1/1992 | Douglass . |
| 5,301,941 | | 4/1994 | Allen . |
| 5,332,214 | | 7/1994 | Tucker, Sr. . |
| 5,358,249 | | 10/1994 | Mendralla . |
| 5,403,007 | * | 4/1995 | Chen . |
| 5,405,136 | * | 4/1995 | Hardman . |
| 5,407,196 | | 4/1995 | Busnardo . |
| 5,445,386 | | 8/1995 | Marshall . |
| 5,447,311 | | 9/1995 | Viollaz et al. . |
| 5,458,332 | | 10/1995 | Fisher . |
| 5,482,282 | * | 1/1996 | Willis . |
| 5,505,450 | | 4/1996 | Stuff . |
| 5,524,331 | | 6/1996 | Pond . |
| 5,531,439 | | 7/1996 | Azzarella . |
| 5,542,675 | | 8/1996 | Micciche et al. . |
| 5,573,469 | | 11/1996 | Dekura . |
| 5,575,472 | | 11/1996 | Magerman et al. . |
| 5,620,381 | | 4/1997 | Spalding . |
| 5,674,132 | | 10/1997 | Fisher . |
| 5,688,190 | | 11/1997 | Rowland et al. . |
| 5,690,562 | | 11/1997 | Sturm . |
| 5,704,850 | | 1/1998 | Shieh . |
| 5,716,290 | | 2/1998 | Baker et al. . |
| 5,766,093 | | 6/1998 | Rohrer . |
| 5,807,190 | | 9/1998 | Krumme et al. . |
| 5,879,243 | * | 3/1999 | Hackman . |
| 5,921,871 | | 7/1999 | Fisher . |
| 5,924,939 | | 7/1999 | Grace et al. . |
| 6,089,993 | | 7/2000 | Woodward et al. . |

* cited by examiner

GOLF CLUB HEAD OR FACE

This application is a divisional, of application Ser. No. 08/760,251, filed Dec. 5, 1996, now U.S. Pat. No. 5,807,190.

FIELD OF THE INVENTION

The invention relates to improvements in construction of golf club heads and faces for golf clubs such as a driver, iron or putter.

BACKGROUND OF THE INVENTION

A large variety of materials have been proposed and in fact used and offered commercially as golf club heads and faces. These materials have been applied monolithically or as inserts in the club face in an attempt to achieve more distance and/or more control over the ball. The list of materials includes polymers, ceramics, and metals, typically the most common stainless steels, BeCu, and lately various titanium alloys, and shape memory materials such as NiTi based and copper based alloys.

Each of these materials has individual properties, different from each other but basically uniform unto themselves and hence provide a surface on a golf club that impacts the golf ball with essentially uniform mechanical properties across the face. For example, a typical titanium alloy such as Titanium 6-4 has a modulus of about 15 million psi and a yield strength of about 120,000 psi at a strain of less than 1%. Other materials will have different moduli and different yield strengths with different associated strain levels but as noted uniform properties as to themselves as used on the face of a golf club.

Since the mechanical characteristics (club speed, materials properties, geometry) at the impact of the club face with the ball determine the course (trajectory, distance, dispersion) of the ball; control of the materials properties can be key to control of the course of the ball. Club head speed and geometry being constant or independent of the specific properties of the material used as the impact surface of the club.

SUMMARY OF THE INVENTION

The invention provides a golf ball striking face of a golf club wherein first and second zones of material are distributed across the striking face, one or more of the first zones being surrounded by one or more of the second zores and the one or more first zones having a higher or lower modulus of elasticity than the one or more second zones. The first and second zones can be differentially heat treated zones of a unitary piece of metallic material. Alternatively, a plurality of the first zones can comprise discrete pieces of a first material such as a shape memory alloy and the second zone can comprise a unitary piece of a second material such as β-titanium or stainless steel wherein the first zones are embedded in the second material.

According to various embodiments of the invention, a plurality of the first zones can comprise individual wire segments arranged in a pattern with central axes of the wire segments intersecting an exposed surface of the striking face. The striking face can be planar or non-planar. A plurality of the first zones can comprise discrete pieces arranged in a pattern and the second zone can comprise a frame surrounding the first zones. The first zones can have various shapes such As polyhedral shapes, cylindrical shapes or any other desired shape. A plurality of the second zones can be separated by a plurality of the first zones such as alternating rings of first and second zones. For example, the first zones can comprise an annular ring and the second zones can include an inner second zone surrounded by the first zone and an outer second zone surrounding the first zone. The first zones can comprise a perimeter weighting arrangement of an insert or club head of a golf club. Alternatively, third zones of material can surround the first and second zones wherein the third zones comprise a dense material providing perimeter weighting of an insert or club head of a golf club. The first zones can comprise solid or hollow metallic members. For example, the one or more first zones can comprise wires of single crystal CuNiAl and the wires can be arranged with central axes thereof intersecting the striking face.

DETAILED DESCRIPTION OF THE INVENTION

Figure 1:
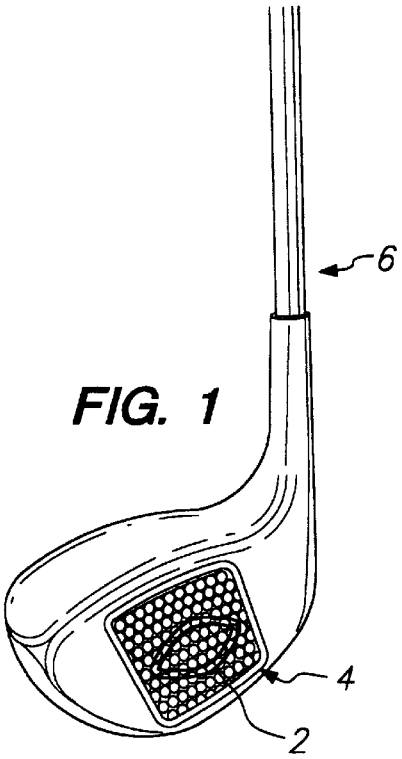
FIG. 1 shows a golf club incorporating a striking face in accordance with the invention.
Figure 2:
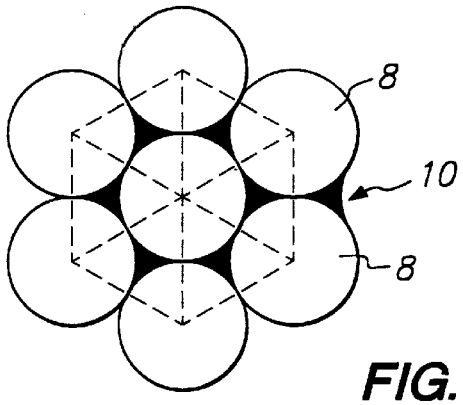
FIG. 2 shows a "pixel" arrangement in accordance with the invention.

The invention allows the mechanical properties of the striking face of a golf club to be controlled and varied at will in incremental areas oil the impact face of the club of as small as 0.0001 square inches. Use of the invention can hence allow the properties of the club face to vary in any pattern over the impact area. As shown in FIG. 1, an elliptically-shaped "sweet spot" 2 on the club face 4 of a driver-type golf club 6 can be created that varies mechanical properties in concentric rings (or any other desirable patterns) in the impact area from high modulus to low modulus and/or any combination of high yield strength and elastic strain characteristics. An analogy to aid in understanding the invention, is a TV screen. Picture the TV screen as the impact area of the golf club and the individual pixels as individually selectable materials from the whole gamut of available materials. One can then see that any conceivable pattern or combination of materials properties can be achieved on the "screen" (impact face) by simply selecting the pixels, as desired, by analogy as a TV image on the screen can be generated. Further picture the individual pixels themselves as having selectable geometry such as round or hexagonal shape. For example, if hexagonal geometry were chosen for individual pixels, the pixels would stack in a manner essentially "tight packed" allowing almost no space between individual pixels while if a round geometry is chosen, the stacked pixels 8 would create interstices 10 (see FIG. 2) between pixels that in turn could be made from any desirable material either the same or different from the round pixels themselves. It can be seen that an infinite combination of materials properties can be created by the combination of choice of "pixel" size and shape and material. The range of the invention allows, at one end uniform properties across the golf club face by selection of a single material, and at the other end an infinite variation of properties in any pattern across the face, by selection of the "pixel" size, shape and material.

Figure 3:
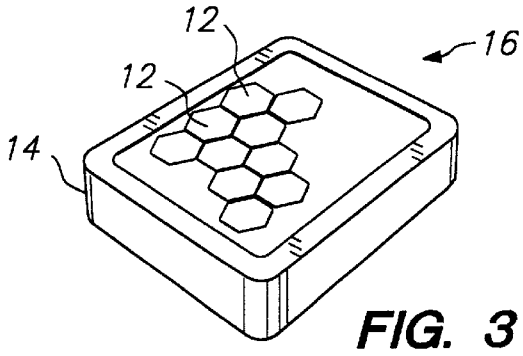
FIGS. 3–13 show various "pixel" arrangements in accordance with the invention.
Figure 4:
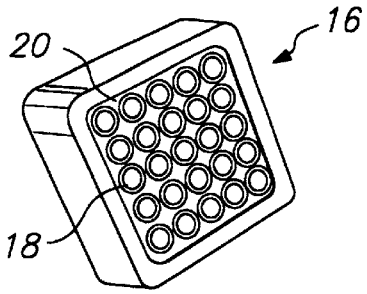
Figure 5:
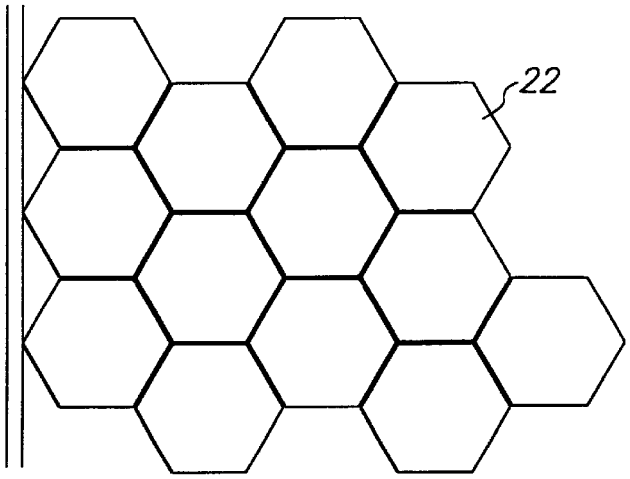
Figure 7:
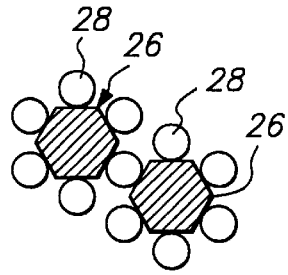
Figure 6:
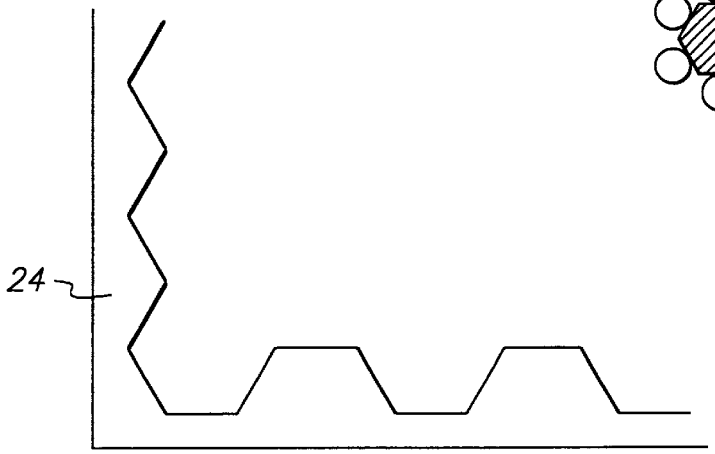
Figure 8:
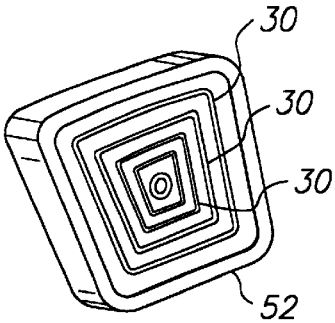
Figure 9:
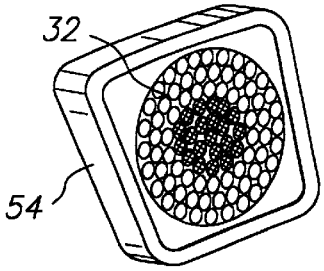
Figure 10:
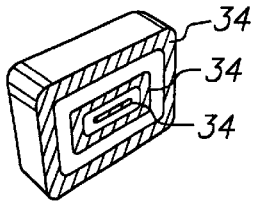
Figure 11:
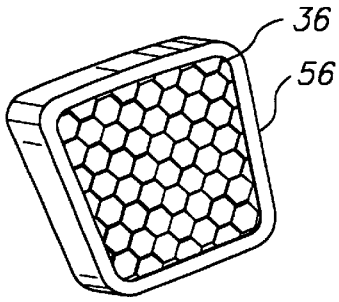
Figure 12:
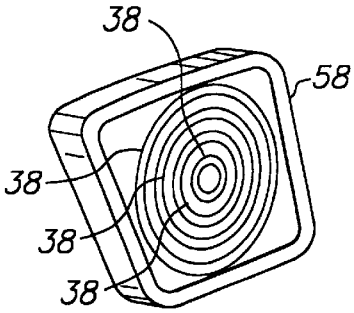
Figure 13:
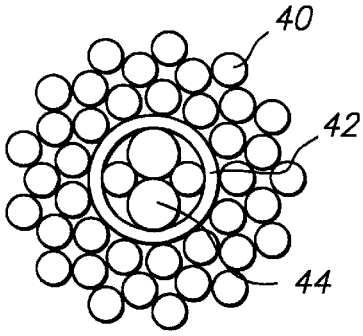

The method to create the striking face according to the invention is quite simple. Using the TV screen analogy, picture the pixels as the ends of individual wires of selected materials such as titanium or polymer or preferably highly elastic shape memory materials (e.g., NiTi based materials). As shown in FIG. 3, the hexagonal-shaped wires 12 are tightly packed into a frame 14 and bonded in a matrix of epoxy polymer (or sintered metal powder or solder or other adhesive matrix). This frame is made to the proper size for an insert 16 on the face of a golf club, either a driver or an "iron" or putter. The framed matrix of "pixels" of wire is then formed by machining or grinding to club face geometry and applied to a club. The resulting insert 16 as noted above can be designed to any desirable combination of materials properties simply by selecting the desired wire materials and diameters or cross sectional geometry. FIGS. 4–7 illustrate the invention in several forms. FIG. 4 shows round "pixels" 18 of uniform diameter in a matrix 20 of epoxy polymer. FIG. 5 shows the pixels 22 as tight packed hexagon cross sections, FIG. 6 shows a frame 24 which mates with the hexagon-shaped pixels, and FIG. 7 shows a combination including a variation of pixel sizes 26,28. Note that the frame can be retained as part of the insert or removed after the "pixels" are bonded together.

As noted above the pixels may also vary in material selection. FIG. 1 illustrates an elliptical "sweet spot" 2 in which the central zone is of a material with a high modulus and progressively the modulus is varied toward the borders of the impact face by selecting materials with progressively lower modulus. Of course, the opposite combination of materials properties (e.g., low modulus at the center/high modulus at the outside) could be implemented or any other combination or a uniform material could be selected.

The preferred embodiments of the invention include versions designed for maximum control (minimum dispersion), maximum distance, or ideal combinations of distance and control. Various patterns for the impact zone are illustrated in FIGS. 8–16 wherein pixels 30,32,34,36,38,40,42,44,46, 48,50 are arranged within frames 52,54,56,58,60,62,64.

Figure 14:
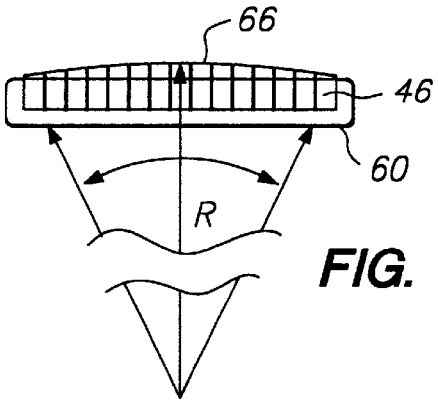
FIG. 14 shows a "pixel" arrangement in accordance with the invention wherein the striking face is non-planar.
Figure 15:
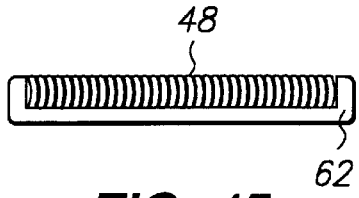
FIG. 15 shows a "pixel" arrangement in accordance with the invention wherein the wires forming the individual pixels comprise curved wire segments.

The thickness of the "pixel" matrix can also be varied to create a "z" axis variation in mechanical response of the club face. This thickness variation can be accomplished by machining of the front or back or both sides of the framed insert or the impact surface of the insert can consist of shorter and longer "pixels" that create a 3 dimensional effect on the impact surface as illustrated in FIG. 14 wherein striking face 66 has a curvature of radius R and the pixels 46 increase in length towards the middle of frame 60. Since materials can be individually selected for properties, surface geometry of the impact surface can also be modified and customized by selective chemical etching of the surface. For example, if a combination of titanium nickel and aluminum "pixels" were selected, chemical etching of the impact surface using a strong basic solution would result in the aluminum elements being etched away at a rate much higher than the nickel-titanium materials. The surface therefore would exhibit raised nickel-titanium elements among lowered aluminum elements. This same basic process can be applied to a variety of materials including polymers to achieve a surface on the impact zone to idealize grip or spin imparted to the ball similar to the now conventional grooves, dots, holes and indents found on club faces. This process can also be used to produce differences in coloration of the materials, which by controlling patterns of application can be used to produce visually observable logos. designs and/or service marks such as company names on the surface to the inserts.

The frame constraining the pixel matrix can be made of materials such as stainless steel, by machining, forging or casting. A polymer frame may also be created by molding or machining. A temporary frame may be used to create the insert form as a matrix bonded together by epoxy resin and then the frame may be removed leaving a frameless insert for application to the club face in an appropriate recess or receiving cavity on the club. The back side of the "pixel" matrix may be supported by the frame structure or the receiving cavity of the club may support the backside of the matrix or both in combination.

Figure 16:
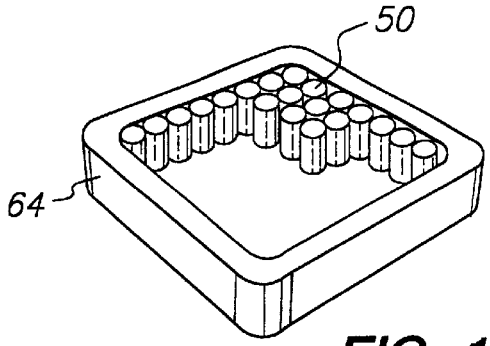
FIG. 16 shows a "pixel" arrangement in accordance with the invention wherein the pixels comprise tubes.

In another variation of the invention, the individual wires 48 ("pixels"), may be curved or bowed (see FIG. 15) to allow both compression and bending strain upon impact with the ball. The individual pixels 50 may also be hollow; for example, thin wall tubes either empty or the lumen filled with another material such as polymer or alternately filled or partially filled with metal or polymer or ceramic material, as shown in FIG. 16.

The invention is additionally illustrated in connection with the following Examples which are to be considered as illustrative of the present invention. It should be understood, however, that the invention is not limited to the specific details of the Examples.

"Driver" Example:

An insert for a golf club "driver" consisting of optimized elastic nickel-titanium wires and beta titanium wires in an epoxy matrix with the higher modulus beta titanium wires forming an outer circular zone of impact and the lower modulus nickel-titanium forming a circular inner zone of impact. This embodiment allows a combination of long distance from the high modulus beta titanium and control from the lower modulus very highly elastic non linear strain characteristics of the nickel-titanium. This arrangement approximates the strain distribution on the ball as it is deformed by the face of the club. Closer approximations are possible by reducing the size of the pixels and adding a third or fourth material and so on with moduli progressively varying. The "opposite" example could consist of high modulus beta titanium or even higher modulus stainless steel forming an inner zone with NiTi lower modulus forming an outer zone.

"Iron" Example:

An insert for a golf club "iron" consisting of a matrix of hexagonal wires per the invention made from highly damping superelastic NiTi alloy or a combination of superelastic NiTi and martensitic NiTi alloy materials. This embodiment would allow a solid yet vibration reduced feel upon impact since the NiTi material in a superelastic or optimized elastic condition has a damping effect resulting from energy absorption deriving from its stress/strain hysterises behavior.

"Putter" Example:

An insert for a golf club putter consisting of a matrix of martensitic NiTi wires alone or in combination with polymer wires. This embodiment: is designed to maximize damping (vibration reduction) on impact with a resulting "dead" or "soft hit" feel for maximum control of the ball in putting.

"Differentially Heated Treated" Example

Figure 17:
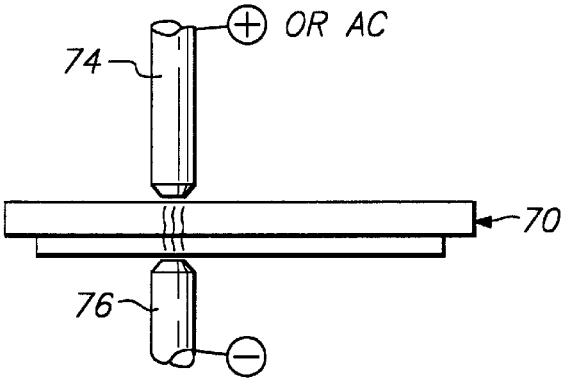
FIGS. 17–21 show an embodiment of the invention wherein a plate of material is differentially heat treated to create zones having different properties.
Figure 18:
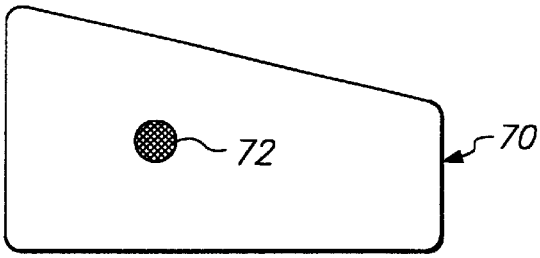

FIG. 17 shows an insert 70 for a golf ball striking surface of a golf club wherein the insert is a solid piece of NiTi based shape memory alloy. The solid piece of NiTi is differentially heat treated such as in a uniform or non-uniform pattern to control the mechanical properties across the interface and achieve an effect similar to the "pixel" approach discussed above. The differential heat treatment preferably provides finite zones 72 surrounded by or surrounding adjacent zones which are unaffected by the heat treatment. The heat treatment can be implemented, for example, by patterning electrodes arranged perpendicular to and opposing the surface being heat treated and passing AC or DC current through the electrodes. The heat treatment step can be carried out by running electrical current from electrode to electrode through the material in order to effect localized heating and provide one or more heat treated zones corresponding to the shape or shapes of the opposed electrodes. In FIG. 17, a nickel-titanium based shape memory alloy insert 70 for a club face is located between a pair of opposed electrodes 74,76. FIG. 18 shows a plan view of the NiTi insert 70 differentially heat treated in FIG. 17. As shown in FIG. 18, the heat treated zone 72 is circular in shape. In heal: treating the insert, a single pair of electrodes could be used to sequentially provide a series of heat treated zones 72 or a plurality of electrodes provided in a desired pattern and having a desired configuration could be used to create any desired pattern of heat treated zones.

Figure 19:
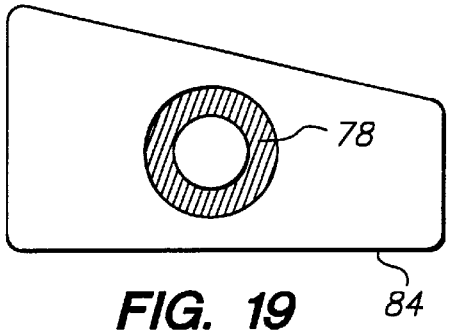
Figure 20:
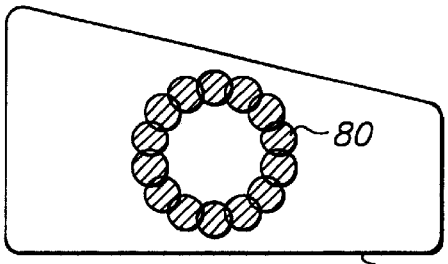
Figure 21:
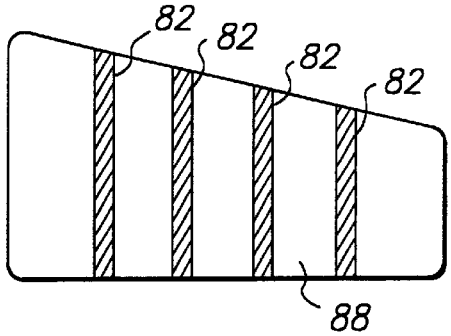

FIGS. 19–21 show examples of patterns of heat treated zones 78,80,82 which can be obtained by differentially heat treating NiTi 84,86,88 inserts for golf club faces. As shown in these figures, by patterning the electrodes and/or by the geometry of the electrodes themselves, differential mechanical properties can be achieved in large variety of patterns that can be idealized for control of the flight of a golf ball. FIG. 19 shows a heat treated zone 78 in the shape of an annular ring and such a heat treated zone could be created by a pair of opposed tubular electrodes. FIG. 20 shows a ring of circular heat treated zones which together form an annular zone 80 created by one or more pairs of opposed electrodes of the type shown in FIG. 17. FIG. 21 shows an example of "strip" heat treated zones 82 created by one or more pairs of opposed strip electrodes (e.g., plate-type electrodes).

"Composite" Example

Figure 22:
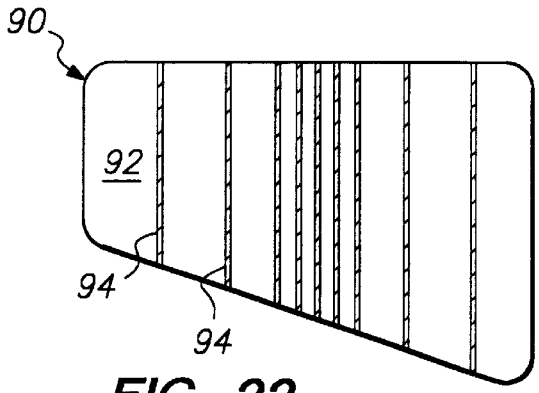
FIGS. 22–23 show an embodiment of the invention wherein the first zones comprise inserts received in grooves of a base material.
Figure 23:
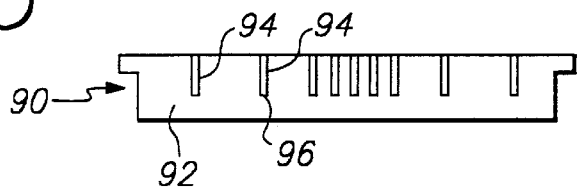

FIGS. 22–23 show an example of a composite insert 90 for a striking face of a golf club. As shown in FIG. 22, the insert includes a base material 92 having one or more embedded members 94 of a material selected for purposes of modifying the properties of the insert. For instance, as shown in FIG. 22, the additional members 94 can be spaced more closely together in the central region of the insert than at the outer edges thereof. As shown in FIG. 23, the base material can include grooves 96 for receiving the additional members 94. The grooves can be provided in any desired pattern such as a uniform pattern or non-uniform pattern (e.g., the grooves can be provided with progressively increasing spacing therebetween towards the outer periphery of the insert). The material of the inserts preferably provides a different modulus than the base material. Although the grooves are shown as extending vertically the grooves could extend in any desired direction or have any desired shape (e.g., the grooves could be provided in a horizontal angled or mixed pattern which combines more than one shape or orientation of the grooves).

"CuNiAl Single Crystal" Example

Figure 24:
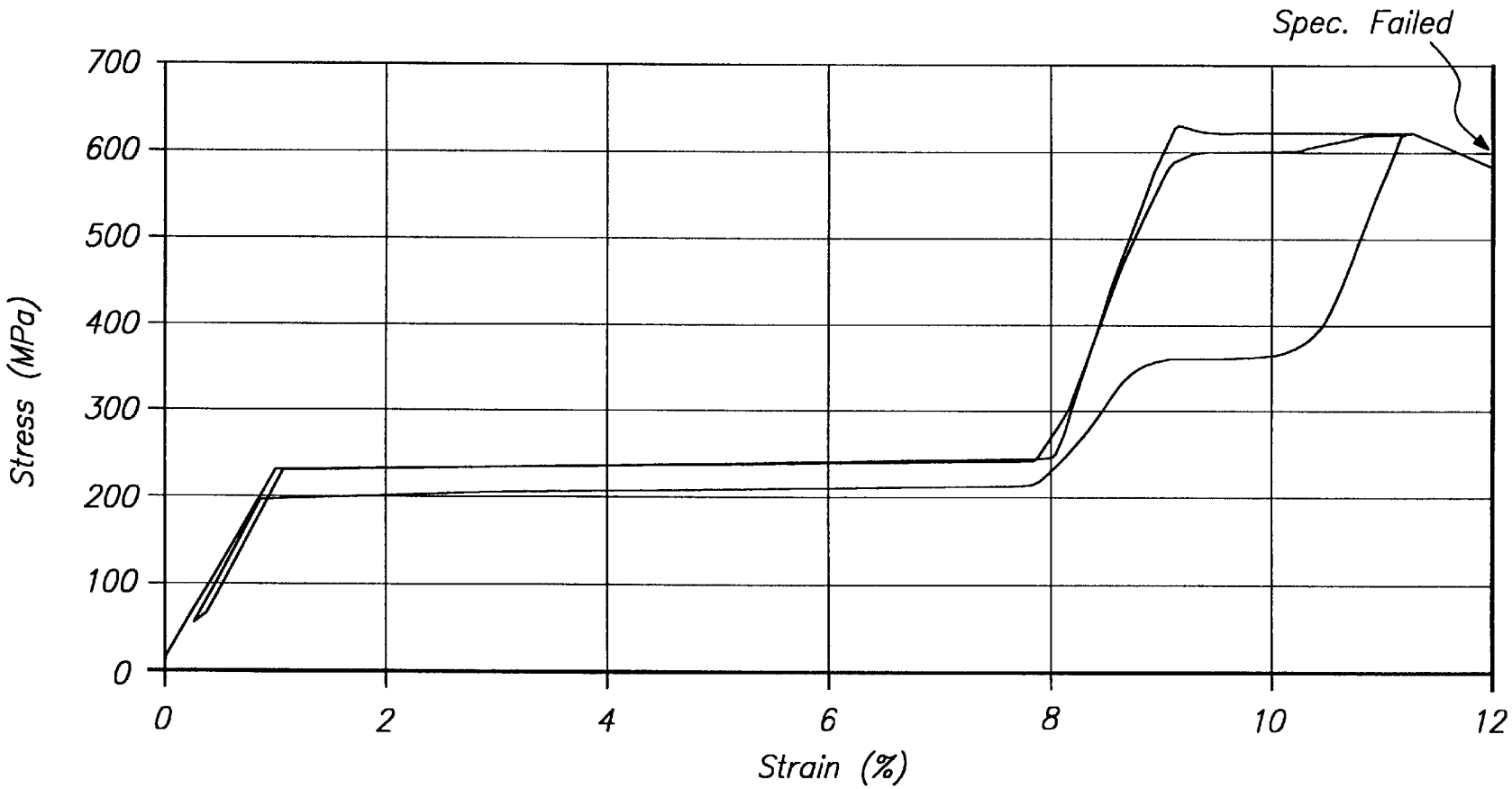
FIG. 24 shows a stress/strain curve of a wire sample of a single crystal CuNiAl wire.

An insert for a striking face of a golf club includes "pixels" (as described earlier) of single crystal CuNiAl. Such an insert would allow much greater deformations of the club insert striking surface. This material has extreme strain ability to deform elastically up to 12–14% strain with a "plateau" at low stress and full elastic recovery with very low hysteresis. FIG. 24 is a stress/strain curve of a wire sample of single crystal CuNiAl having a diameter of 0.060 inch. The strain properties of such material would allow a golf ball to remain on the club for a longer period of time giving an increased feel of control to the user.

"Perimeter Weighting" Example

Figure 25:
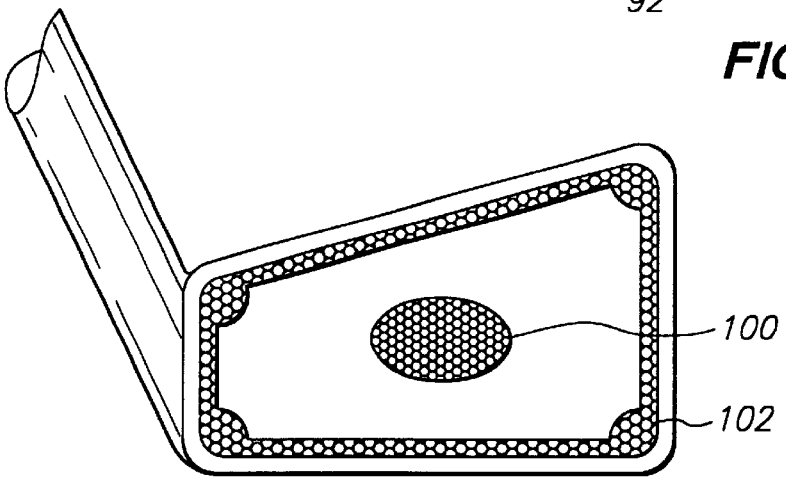
FIGS. 25–26 show an embodiment of the invention incorporating perimeter weighting.
Figure 26:
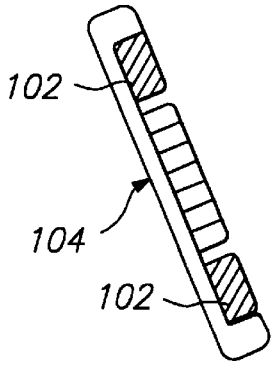
Figure 27:
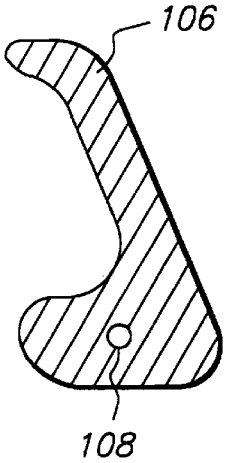
FIG. 27 PRIOR ART
FIG. 27 shows a prior art perimeter weighting arrangement.

FIG. 25 shows an example of how perimeter weighting can be added to the golf club according to the invention. In the embodiment shown, the central region 100 of the club face can include a pixel or other arrangement such as shown in FIGS. 1–23. The central region is entirely or partly surrounded by high density "pixels" 102 such as rods of heavy materials such as pure metals (e.g., uranium, tungsten, molybdenum, lead, etc.). The perimeter weighting concept allows the striking face to be made much thinner. For instance, as shown in FIG. 26, the cross-section of an "iron-type" club face 104 having the perimeter weighting 102 can be substantially uniform in thickness whereas a conventional cast or forged stainless steel iron-type club, such as is shown in FIG. 27, has an increased cross-section around the top 106 and bottom 108 thereof.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A putter head, comprising:

a club face having a recess therein;

an insert fitted in the recess, the insert having a plurality of cylindrical projections, the cylindrical projections having central axes arranged in a uniform pattern such that distances between the central axes of adjacent projections are the same, the projections having end surfaces forming a planar striking face of the putter head, and the projections are of polymer material.

2. The putter head of claim 1, wherein the central axes are perpendicular to the planar striking face.

3. The putter head of claim 1, wherein outer surfaces of adjacent projections are in contact with each other.

4. The putter head of claim 1, wherein the projections are in a close packed array with adjacent surfaces of the projections in contact with each other.

5. The putter head of claim 1, wherein the projections comprise polymer wires of uniform diameter.

6. The putter head of claim 1, wherein interstices are located between the projections.

7. The putter head of claim 1, wherein the projections comprises discrete pieces of the same material.

8. The putter head of claim 1, wherein sidewalls of the projections are not bonded together.

9. The putter head of claim 1, wherein the projections have adjacent surfaces tightly packed together.

10. The putter head of claim 1, wherein the projections provide vibration reduction which enhances putting control of a golf ball.

11. A putter head, comprising:

a club face having a recess therein;

an insert fitted in the recess, the insert having a plurality of cylindrical projections, the cylindrical projections having central axes arranged in a uniform pattern such that distances between the central axes of adjacent projections are the same, the projections having end surfaces forming a planar striking face of the putter head, the projections comprising raised nickel-titanium elements among lowered aluminum elements or raised polymer projections.

12. A putter head, comprising:

a club face having a recess therein;

an insert fitted in the recess, the insert having a plurality of cylindrical projections, the cylindrical projections having central axes arranged in a uniform pattern such that distances between the central axes of adjacent projections are the same, the projections having end surfaces forming a planar striking face of the putter head, the projections having a diameter of 0.060 inch.

* * * * *

UNITED STATES PATENT AND TRADEMARK OFFICE

CERTIFICATE OF CORRECTION

PATENT NO. : 6,277,033 B1
DATED : August 21, 2001
INVENTOR(S) : John F. Krumme and Frank C. Dickinson It is certified that error appears in the above-identified patent and that said Letters Patent is hereby corrected as shown below:

Title page,
Assignee, delete "Pixl Golf Technologies, Inc." and insert
-- Pixl Golf Company --.

Signed and Sealed this

Second Day of April, 2002

*Attest:*

*Attesting Officer*

JAMES E. ROGAN
*Director of the United States Patent and Trademark Office*